United States Patent [19]

Melde-Tuczai et al.

[11] Patent Number: 4,836,171

[45] Date of Patent: Jun. 6, 1989

[54] INJECTION-TYPE INTERNAL COMBUSTION ENGINE

[75] Inventors: Helmut Melde-Tuczai; Othmar Skatsche; Josef Rachholz, all of Graz, Austria

[73] Assignee: A V L Gesellschaft fur Verbrennungskraftmaschinen und Messtechnik M.B.H., Prof. Dr. Dr. h.c. Hans List, Graz, Austria

[21] Appl. No.: 171,439

[22] Filed: Mar. 21, 1988

[30] Foreign Application Priority Data

Mar. 23, 1987 [AT] Austria ..... 690/87

[51] Int. Cl.[4] ..... F02M 39/00

[52] U.S. Cl. ..... 123/508; 123/90.27; 123/315

[58] Field of Search ..... 123/508, 509, 432, 315, 123/90.27

[56] References Cited

U.S. PATENT DOCUMENTS

| | | | |
|---|---|---|---|
| 4,068,630 | 1/1978 | Bennett | 123/315 |
| 4,441,166 | 5/1984 | Amemori | 123/90.27 |
| 4,593,657 | 6/1986 | Aoi | 123/90.27 |
| 4,602,604 | 7/1986 | Kauer | 123/508 |
| 4,651,684 | 3/1987 | Masuda | 123/432 |
| 4,651,684 | 5/1987 | Masuda | 123/315 |
| 4,709,667 | 12/1987 | Ichihara | 123/90.27 |
| 4,721,075 | 1/1988 | Kasai | 123/508 |
| 4,741,302 | 5/1988 | Oda | 123/315 |
| 5,299,871 | 1/1967 | Adfelbeck | 123/90.27 |

FOREIGN PATENT DOCUMENTS

| | | | |
|---|---|---|---|
| 382429 | 2/1987 | Austria . | |
| 2809157 | 9/1979 | Fed. Rep. of Germany | 123/315 |
| 1076310 | 10/1954 | France . | |
| 0159342 | 8/1985 | Japan | 123/315 |
| 0070985 | 1/1931 | Sweden | 123/508 |

*Primary Examiner*—Carl Stuart Miller

*Attorney, Agent, or Firm*—Watson, Cole, Grindle & Watson

[57] ABSTRACT

An injection-type internal combustion engine with cylinders arranged in line, with two overhead camshafts, and four valves and a central pump nozzle for each cylinder, and with detachable rocker arms being provided on the cylinder head above the respective camshaft, for actuating the pump nozzles. With this arrangement, the cams for the rocker arms actuating the pump nozzles are operated from the two camshafts in turn, i.e., the first camshaft actuates the pump of one cylinder and the second camshaft actuates that of the adjacent cylinder, each rocker arm being mounted separately. This will facilitate assembly and disassembly of the pump nozzle including the corresponding actuating mechanism and valve gear.

5 Claims, 3 Drawing Sheets

INJECTION-TYPE INTERNAL COMBUSTION ENGINE

BACKGROUND OF THE INVENTION

This invention relates to an injection-type internal combustion engine, especially a diesel engine, whose cylinders are arranged in line, with two overhead camshafts, and four valves and a central pump nozzle for each cylinder, and with detachable rocker arms being provided on the cylinder head above the respective camshaft, for actuating the pump nozzles.

DESCRIPTION OF THE PRIOR ART

In a previous design of an injection-type internal combustion engine of this kind, especially a diesel engine, with in-line cylinders, an overhead camshaft, and two valves and a pump nozzle per cylinder—comprising rocker arms for actuating the pump nozzles, which are mounted detachably on the cylinder head (cf. Austrian Patent No. 382,429)—one single through-going bearing axle is provided for all rocker arms actuating the pump nozzles for reasons of space. Though-going bearing axles for the rocker arms of pump nozzles in engines with overhead camshafts will obstruct any work to be done only on the valves or the valve gear, as the nozzle rocker arms cannot be removed without removal of their joint bearing axle from the cylinder head. In such instances assembly and disassembly of the nozzle rocker arms is difficult. What is more, all rocker arms must be newly adjusted upon re-assembly of the cylinder head mechanism, which will require much additional work.

Similar disadvantages are typical of an injection-type internal combustion engine as described in French Pat. No. 1,076,310, where all pump nozzle rocker arms again are pivoted on a single axle, and where a through-going adjusting spindle combined with a control mechanism is additionally provided for all pump nozzles.

SUMMARY OF THE INVENTION

It is an object of the present invention to avoid such disadvantages and to provide an internal combustion engine of the above type which will permit the rocker arms actuating the pump nozzles and the pump nozzles themselves to be assembled and disassembled in a simple manner.

According to the invention this is achieved by operating the cam for the rocker arms actuating the pump nozzles from the two camshafts in turn, i.e., one camshaft for one cylinder, and the other camshaft for the adjacent cylinder, each rocker arm being separately. This will enable the rocker arm actuating the pump nozzle to be easily removed, independently of the other rocker arms, while the pump nozzle may be easily disassembled for purposes of maintenance and repair. In addition, access to the valve gears is enhanced.

In a preferred embodiment of the invention the individual rocker arms are detachably mounted on bearing axles or blocks screw-fastened on the cylinder head, the screws serving for the purpose of securing bearing parts of the camshafts at the same time. In this manner accessibility of the individual rocker arms is further improved and the arrangement of valve gear and rocker arms is more economical.

According to another preferred variant easy removal of rocker arms and bearings is obtained by individually supporting the rocker arms by means of bearing part which is detachably fastened, e.g., with screws, independently of the camshaft bearing, and which will support the bearing axle of a rocker arm actuating a pump nozzle.

A particularly economical method of mounting and supporting the rocker arms actuating the pump nozzle is obtained by configuring the bearing axles used for individually mounting the rocker arms such that they do not extend beyond two adjacent bearing parts for either of the two camshafts, as seen in longitudinal direction of the engine.

DESCRIPTION OF THE DRAWINGS

Following is a more detailed description of the invention as illustrated by the attached drawings, in which.

DETAILED DESCRIPTION OF THE PREFERRED EMBODIMENT

Figure 1:
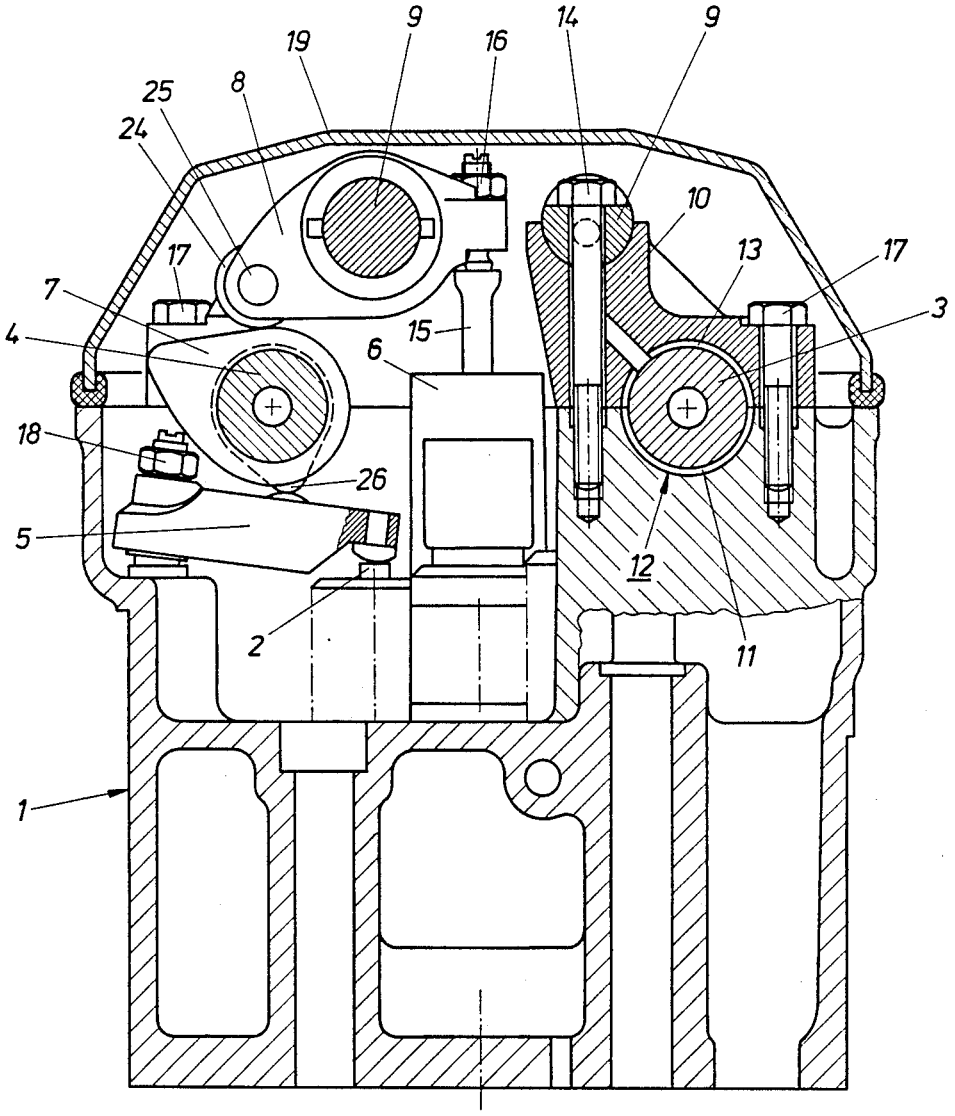
FIG. 1 is a cross-section through the cylinder head of a preferred embodiment of the engine as described, along line I—I in FIG. 2.

In the engine according to the invention four valves 2 per cylinder are actuated in the cylinder head 1 from a first and a second overhead camshaft 3 and 4 via cam followers 5. A pump nozzle 6 is actuated by a cam 7 of the camshaft 3 or 4 via a rocker arm 8. The rocker arm 8 is located on a rocker arm bearing consisting of a bearing axle 9 and bearing parts 10. The upper edge of the cylinder head 1 extends upwards as far as the center of camshafts 3 and 4. The lower parts 11 of the camshaft bearings 12 are located in partition walls of the cylinder head 1. The bearing parts 10 are designed so as to house the upper parts 13 of the camshaft bearings 12.

Figure 2:
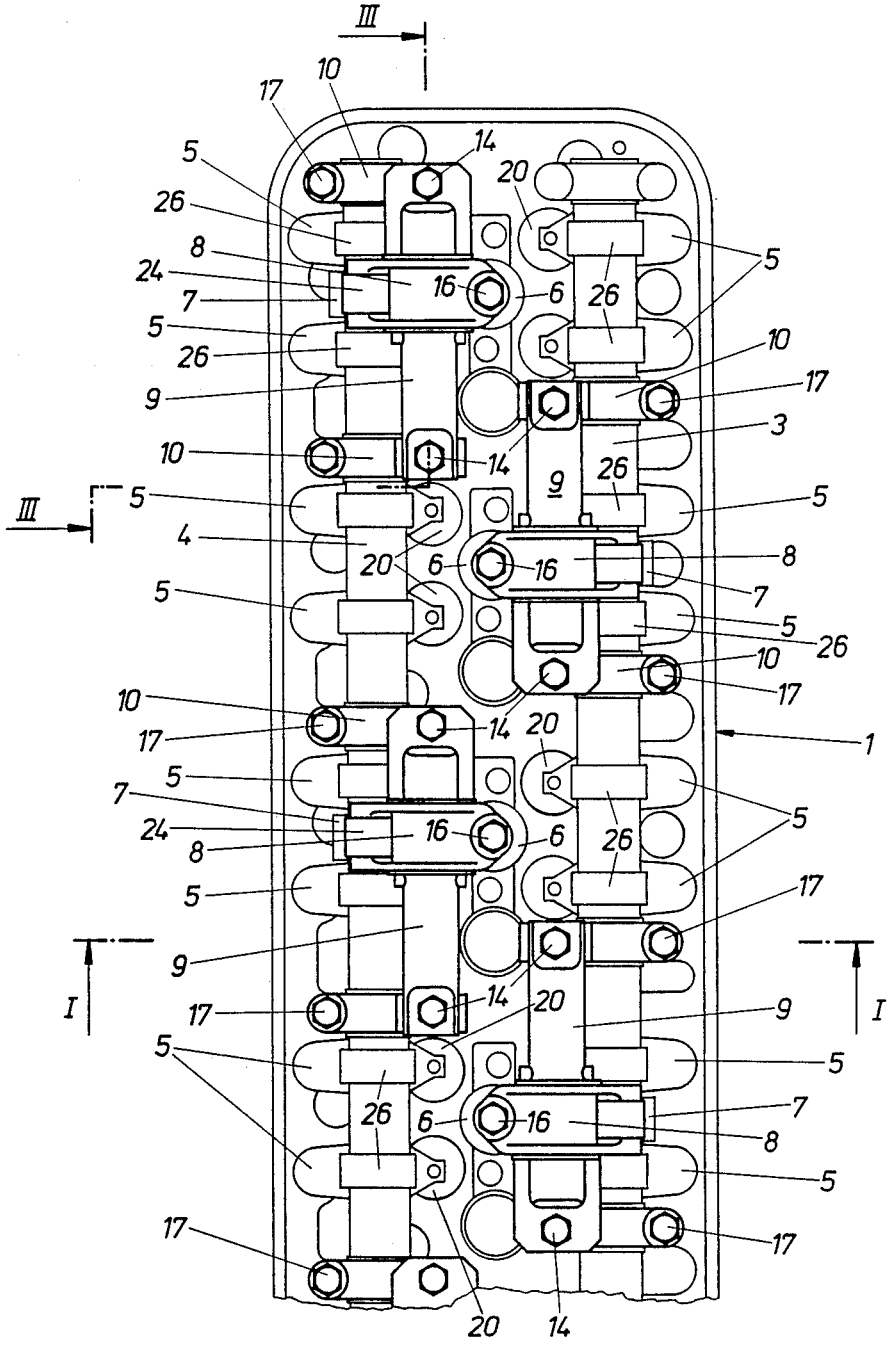
FIG. 2 is a view from above of the cylinder head of the engine as in FIG. 1, at a reduced scale, with the cylinder head cover removed.

In the engine presented here the favorable design of the rocker arm drive 7, 8, 9, and thus the camshaft bearings 12, is achieved by positioning the bearings in alternating order, i.e., once on the right-hand side of the cylinder head 1, and once on the left-hand side. The pump nozzle 6 is actuated in turn from the camshaft on the right-hand side and from that on the left-hand side, i.e., 3 and 4, respectively, in correspondence with the entire rocker-arm arrangement (FIG. 2).

The injection-type internal combustion engine described here preferably is a diesel engine with cylinders arranged in line, comprising an overhead camshaft 3 as well as two valves 2 and a pump nozzle 6 for each cylinder. Each cylinder is provided with a cam 7 actuating a rocker arm 8 for the pump nozzle 6 and, possibly, cam followers 5 for actuating the valves 2. The bearing axle 9 of the rocker arms 8 is located on the upper half of the bearing of camshaft 3, and the rocker arms 8 themselves or their bearing axles 9 are detachably mounted on the cylinder head 1. Two further valves 2 per cylinder and a second camshaft 4 are provided. According to the invention the cam 7 for the rocker arms 8 actuating the pump nozzles 6 is operated alternately from the camshaft 3 for one cylinder, and from the other camshaft 4 for the adjoining cylinder, each rocker arm 8 being fastened individually. Each of the rocker arms 8 is secured above the corresponding camshaft 3 or 4, for instance by means of screws 14, such that each rocker arm 8 or its bearing can separately be removed from the valve gear (2, 3, 4, 5), if necessary. Preferably, the bearing axles 9 or bearing blocks of the rocker arms 8 are detachably fastened on the cylinder head 1 by means of screws 14, which are also used for securing the bearing parts 10 configured as brackets for the camshafts 3 and 4.

It would also be possible for the bearing 12 of camshaft 3 or 4 to have one or more separate bearing parts on its upper side, which are detachably fastened, for instance with screws, and are used for holding the bearing axle 9 of a rocker arm 8 actuating a pump nozzle 6.

Figure 3:
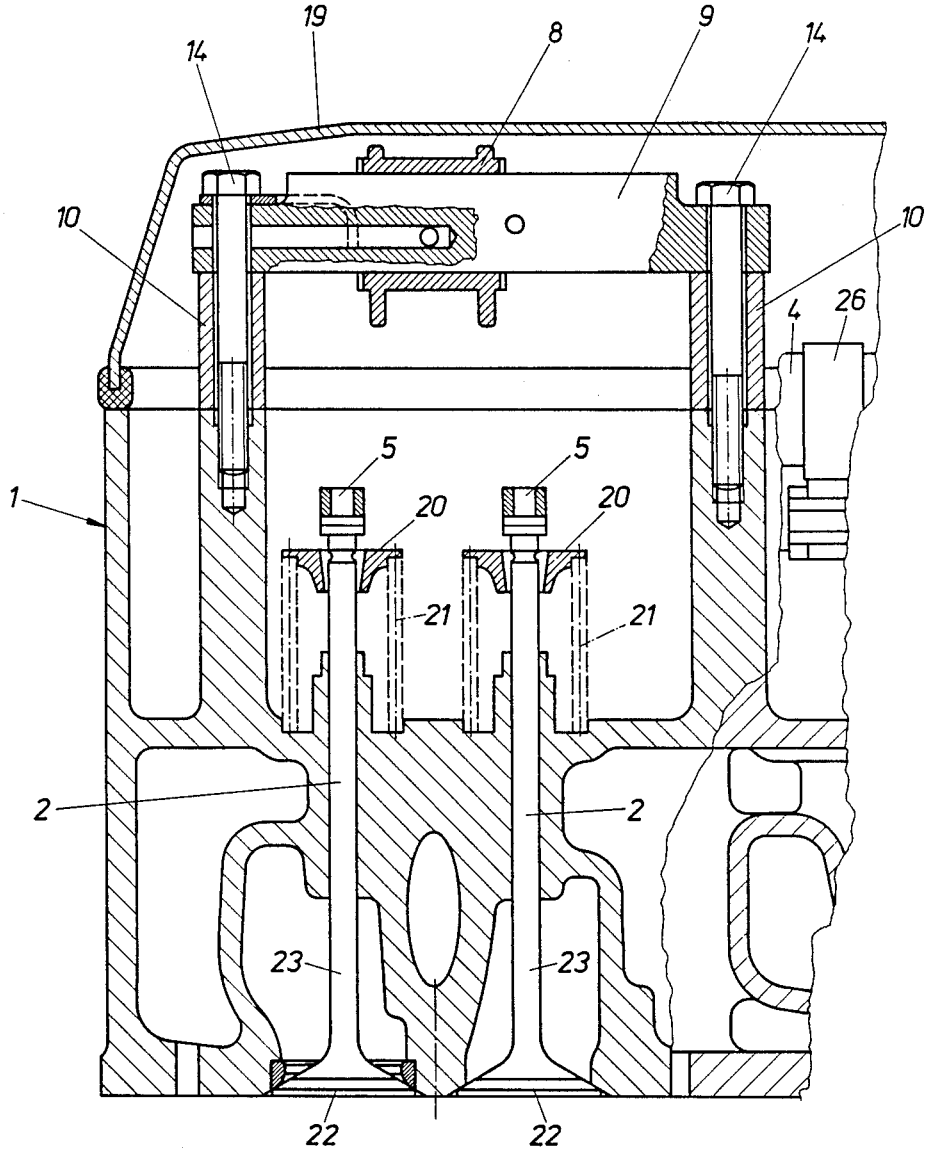
FIG. 3 is a longitudinal section of the engine presented in FIGS. 1 and 2, along line III—III in FIG. 2.

FIG. 3 shows that in the variant under discussion the bearing axles 9 of the individual rocker arms 8—as seen in longitudinal direction of the engine—do not extend beyond two adjoining bearing parts 10 for either of the two camshafts 3, 4.

As is indicated in FIG. 1, the rocker arm 8 is actuated on one end by the cam 7 via a roller 24. This roller 24 is supported on the rocker arm 8 by means of an axle 25. On its other end the rocker arm 8 is connected with the tappet 15 of the pump nozzle 6 by means of a screwed connection 16. Each camshaft 3 and 4 carries cams 26 used for driving the followers 5 actuating the valves 2. The followers 5 are fastened to the cylinder head 1 by a screwed connection 18. Furthermore, each camshaft bearing 12 has another screw 17 for fastening the bearing part 10 to the cylinder head 1. The cylinder head cover is marked 19.

FIG. 2 shows the staggered arrangement of the rocker arm bearings (rocker arm 8, bearing axle 9) and the camshaft bearings (bearing part 10), with the cylinder head cover removed.

FIG. 3 shows the pair of valves cooperating with the camshaft 4. This pair of valves comprises two valves 2, each with a valve disk 22, a valve stem 23 and a spring retainer 20. The valve springs indicated by dash-dotted lines are marked 21.

The special advantage of the embodiment shown in the drawings is that in this instance it will suffice to remove one rocker arm bearing axle 9 in order to permit disassembly of a particular pump nozzle 6, while the two camshafts 3 and 4 and all remaining valve gear will remain in place.

We claim:

1. An injection-type internal combustion engine, comprising even and odd alternating numbers of cylinders arranged in line and a cylinder head with a first and a second overhead camshaft, each of said cylinders comprising four valves and a central pump nozzle, detachable rocker arms being provided on said cylinder head above said first and second overhead camshaft, for actuation of said pump nozzles via cams secured to said first and second overhead camshaft, wherein each of said rocker arms is mounted separately and said rocker arms of adjacent pump nozzles are operable from corresponding cams of different ones of said camshafts, such that said first overhead camshaft actuates said rocker arms of said pump nozzles of said even numbers of cylinders and said second overhead camshaft actuates said rocker arms of said pump nozzles of said odd numbers of cylinders.

2. An injection-type internal combustion engine according to claim 1, wherein said engine is a diesel engine.

3. An injection-type internal combustion engine according to claim 1, wherein each of said individual rocker arms is detachably mounted on a bearing axle or bearing block fastened on said cylinder head with screws, wherein said screws securing bearing parts of said first and second overhead camshaft.

4. An injection-type internal combustion engine according to claim 1, wherein bearing parts are provided for individually supporting said rocker arms, which are designed to support a bearing axle of said rocker arm actuating said pump nozzle, and wherein said bearing parts are detachably fastened independently of bearing parts of said first and second camshaft.

5. An injection-type internal combustion engine according to claim 3 or 4, wherein said bearing axles used for individually mounting said rocker arms—seen in longitudinal direction of said engine—do not extend beyond two adjacent bearing parts for each of said first and second overhead camshaft.

* * * * *